US005944640A

United States Patent [19]

Larsson

[11] Patent Number: 5,944,640

[45] Date of Patent: Aug. 31, 1999

[54] APPARATUS FOR CARRYING OUT EXERCISE OF THE BODY

[75] Inventor: Bo Larsson, Halmstad, Sweden

[73] Assignee: Aerobix Scandinavia AB, Angelholm, Sweden

[21] Appl. No.: 08/722,211

[22] PCT Filed: Feb. 7, 1996

[86] PCT No.: PCT/SE96/00144

§ 371 Date: Dec. 4, 1996

§ 102(e) Date: Dec. 4, 1996

[87] PCT Pub. No.: WO96/25204

PCT Pub. Date: Aug. 22, 1996

[30] Foreign Application Priority Data

Feb. 15, 1995 [SE] Sweden ..... 9500544

[51] Int. Cl.[6] ..... A63B 21/068

[52] U.S. Cl. ..... 482/96; 482/23; 482/141; 482/145; 482/904

[58] Field of Search ..... 482/23, 24, 91, 482/95, 96, 141, 143, 131, 904, 129, 145, 148, 79, 80

[56] References Cited

U.S. PATENT DOCUMENTS

| | | | |
|---|---|---|---|
| 324,513 | 8/1885 | Albrecht | 482/24 |
| 1,104,505 | 7/1914 | Holworthy | 482/24 |
| 1,374,697 | 4/1921 | Werndli | 482/95 |
| 1,585,748 | 5/1926 | Wendelken | 482/143 |
| 2,262,761 | 11/1941 | Gay | 482/23 |
| 2,783,045 | 2/1957 | Bosch | 482/96 |
| 3,399,888 | 9/1968 | Jensen | 482/96 |
| 3,521,848 | 7/1970 | Aase | 482/24 |
| 3,752,474 | 8/1973 | Macabet et al. | 482/131 |
| 4,084,815 | 4/1978 | Flannery | 482/131 |
| 4,371,161 | 2/1983 | Williams | 482/79 |
| 5,176,602 | 1/1993 | Roberts | 482/131 |
| 5,209,712 | 5/1993 | Ferri | 482/139 |
| 5,254,065 | 10/1993 | Pollock | 482/904 |
| 5,403,253 | 4/1995 | Gaylord | 482/142 |

FOREIGN PATENT DOCUMENTS

| | | | |
|---|---|---|---|
| 2538707 | 7/1984 | France | 482/148 |
| 2948136 | 7/1981 | Germany | 482/129 |
| 78676 | 10/1933 | Sweden | 482/92 |

*Primary Examiner*—Richard J. Apley
*Assistant Examiner*—Victor K. Hwang
*Attorney, Agent, or Firm*—Antonelli, Terry, Stout & Kraus, LLP

[57] ABSTRACT

Apparatus for performing body exercises for muscle training purposes and muscle growing purposes. A wire (3) is provided with a number of attachment members (4) and at least one hand grip (6). One of the attachment members is used to attach the wire to a vertical surface. A foot support (7) is placed beneath the hand grip when the wire is extended at substantially 90° from the vertical surface. A person supports himself or herself on the foot support, grips the at least one hand grip, and performs exercises.

14 Claims, 7 Drawing Sheets

FIG. 9
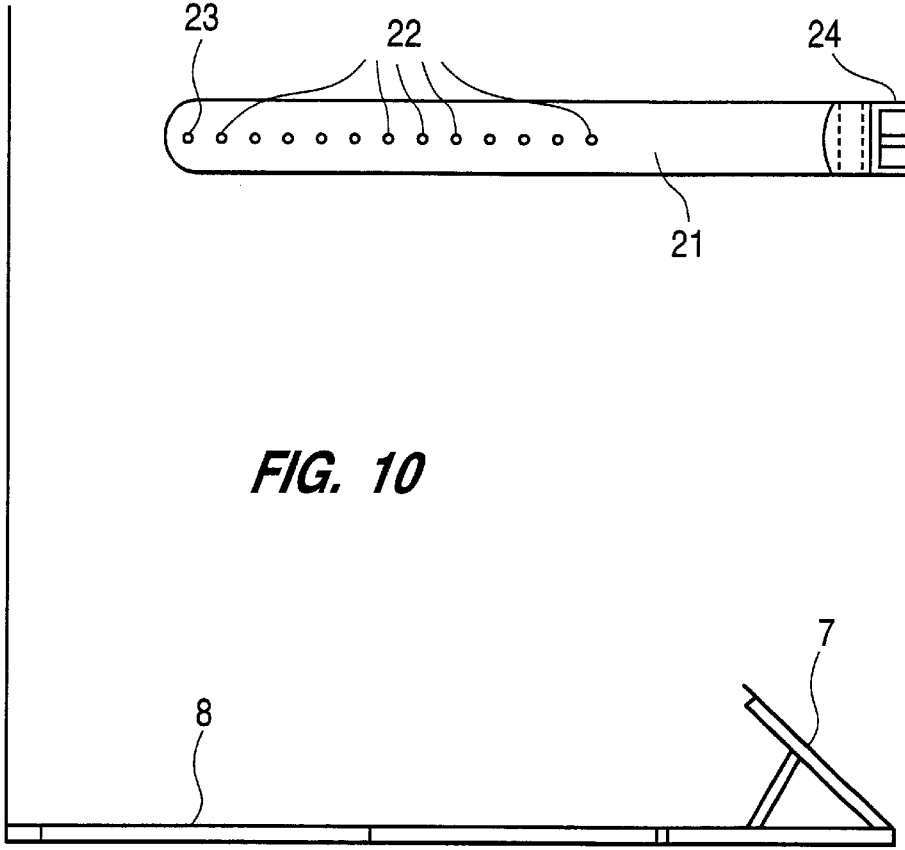
FIG. 10
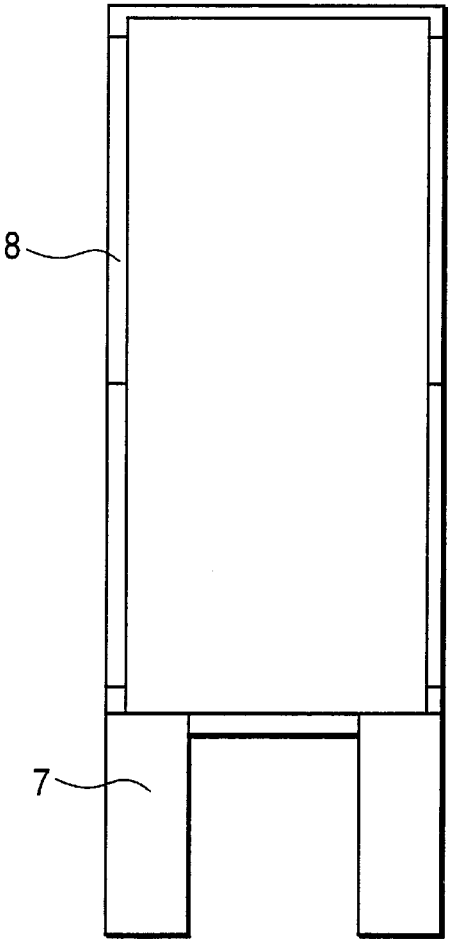
FIG. 11

APPARATUS FOR CARRYING OUT EXERCISE OF THE BODY

BACKGROUND OF THE INVENTION

The present invention relates to an apparatus for use in exercise of the body, mainly for purposes of muscle growth.

The interest in and the need to perform body exercises are widely known, so as to achieve well-being, both physically and psychologically, and are increasing all the time, particularly as exercise from normal work activity decreases, increasing the need for spare-time activity to provide body exercises, muscle stress or simply physical exercise of different kinds. There has also been an increase in use of special muscle exercise with the aid of different types of tools, which are always of such a complicated and space-demanding design that they are seldom to be found in places other than pure training institutes, which to a high degree are used by muscle or body builders. The majority of the known exercise tools are based on working with relatively big loads which are extremely difficult to move and carry on travels and when moving. In order to reach a desired result, it is a main desire that physical exercises or body exercises be carried out with a relatively high degree of regularity, and this can be difficult in cases where people do not desire to be confined to the room in which the desired exercise tools are available. There is a great need for a simple and easy-to-use exercise tool which to a large extent may be a substitute for the exercise tools available in special rooms such as a gym.

SUMMARY OF THE INVENTION

The task of the present invention is to provide a solution to such needs.

The task is solved by the present invention in that a wire is provided with a number of attachment members and one or several hand-grips. One attachment is in the form of a loop which cooperates with a hook that is positioned on a wall surface or the like. The attachment members are arranged with spaces at least a predetermined distance from the at least one hand grip, which is in the form of a yoke, with a grip part extending between the ends of the yoke. The grip part is in the form of a tube and is rotatable. The yoke is connected to a loop in the wire by a snap hook. A foot support is provided on a surface, e.g., a floor, preferably approximately below the hand grip, when the wire is at substantially a 90° angle with respect to the wall surface. The foot support forms an angle against the base in a direction against the wall surface. The foot support can be raised or lowered.

An apparatus according to the present invention is above all very easy to carry in simple luggage and is very simple to use in any variable space, e.g. a hotel room, rent-room, ship cabin or the like. It is also very easy to use in a working place, e.g. in an office, or the like, in order to achieve an activity for otherwise sedentary persons who have the freedom of choice to perform simple and/or difficult body exercises according to need and with any desired load. Both freedom of choice and versatility are very big with an apparatus according to the present invention, which may be incorporated in a sophisticated training program. The intensity of body exercises, both in question of frequency and load, is adjustable according to the desire of each individual.

BRIEF DESCRIPTION OF THE DRAWINGS

The invention will be described in more detail with reference to the enclosed drawings. In the drawings:

FIG. 9 is a view of another attachment part for an apparatus according to the present invention.

FIG. 10 is a side view of a foot support usable in an apparatus according to the present invention.

FIG. 11 is a top plan view of the foot support arrangement of FIG. 10.

DETAILED DESCRIPTION OF A PREFERRED EMBODIMENT

Figure 1:
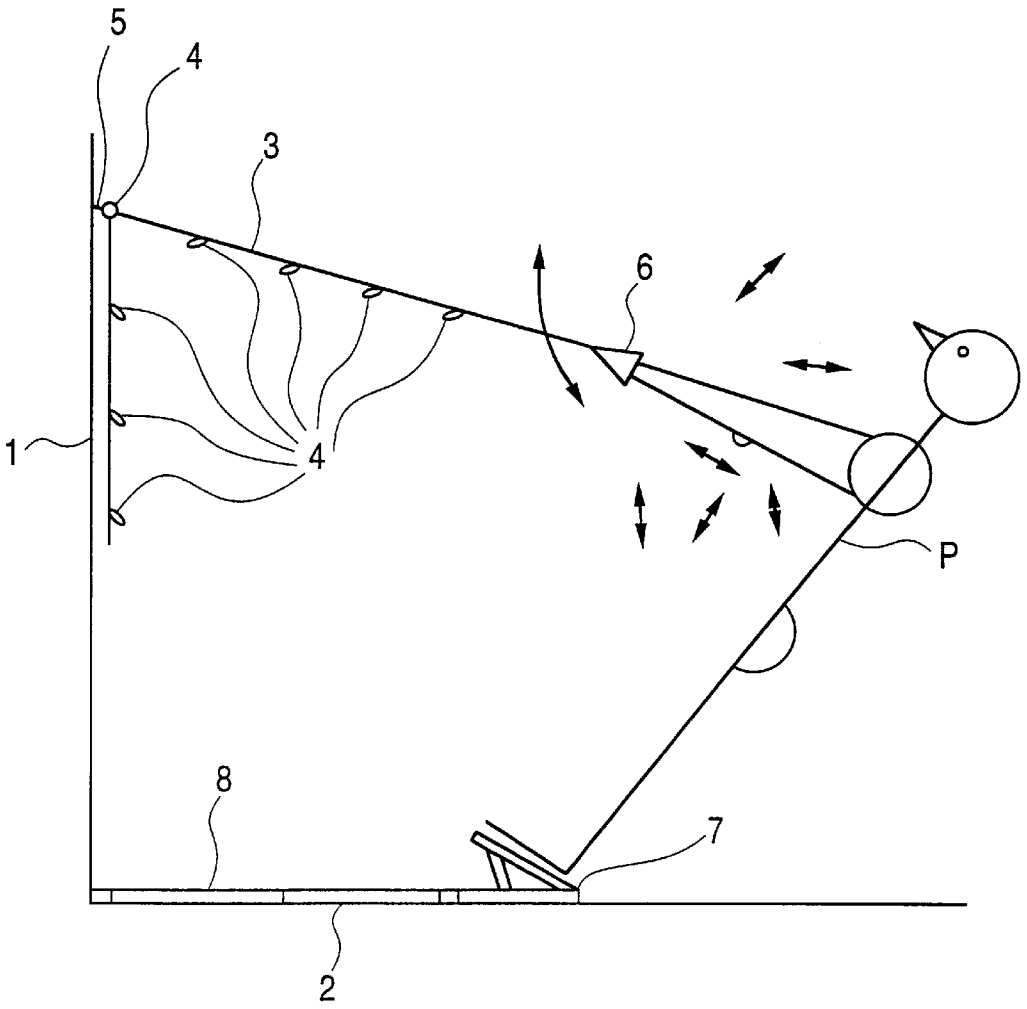
FIG. 1 is a schematic side view of an embodiment of an apparatus according to the present invention, with a person performing exercises utilizing the invention.

The embodiment of an apparatus according to the present invention as shown in FIG. 1 is arranged at a wall surface 1 extending from a base 2 in the form of a floor. The apparatus according to the invention itself is in the form of a wire 3 with a number of attachment members 4, which may have the form of loops in the wire 3 or in the form of attached rings or the like, whereby one of the loops cooperates with a hook 5, which is attached to the wall surface 1. The free end of the wire 3 is provided with a hand grip 6, which may be of any desired design.

In FIGS. 3, 4 and 7 and 8 are exemplified two different types of hand grips 6. The handgrip 6 is gripped by a person P who has the desire to perform any of a number of body exercises, which are exemplified by the double directed arrows in FIG. 1. In order to reach the desired result, a foot support 7 may be positioned on the base 2. In order to prevent displacement of the foot support 7 against the wall surface 1, an arrangement of struts 8 may be arranged between the foot support 7 and the wall surface 1.

The person P has complete freedom in the choice of load under performance of the different body exercises by choosing the length of the wire between the hook 5 and the hand grip 6, by selecting the position of the attachment member 4 that is hooked to the hook 5. The less the inclination of the wire 3, the less load, and the greater the inclination, the greater load. At greater inclination and greater load, there is a greater load on the foot support 7.

Figure 2:
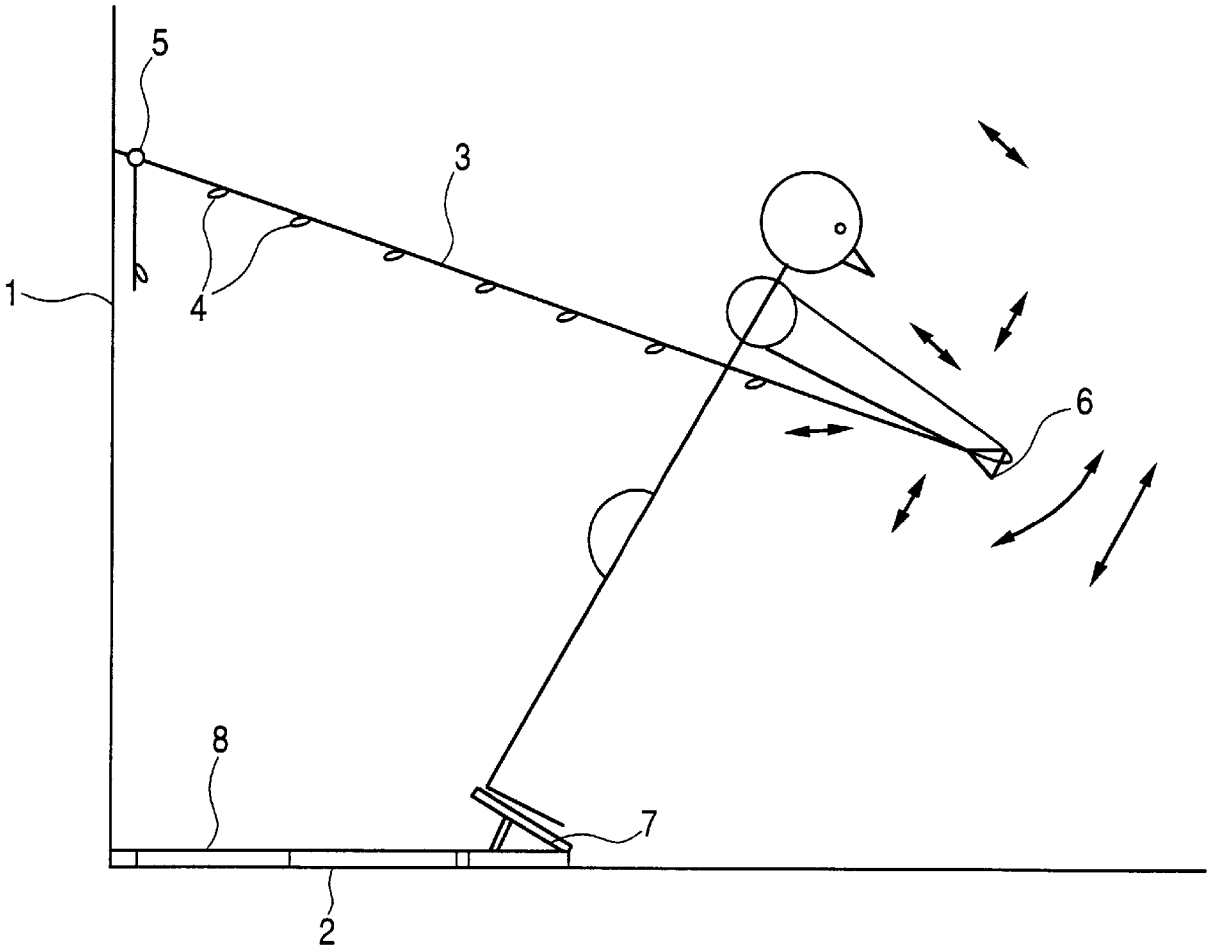
FIG. 2 is a similar view of the apparatus according to the present invention with the person using the apparatus in a reversed position.

The apparatus according to the present invention is shown in FIG. 2 when the person P using the apparatus has his or her back turned to the wall surface 1.

Figure 4:
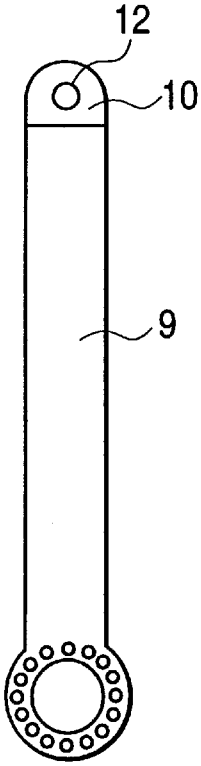
FIG. 4 is a side view of the hand grip of FIG. 3.
Figure 3:
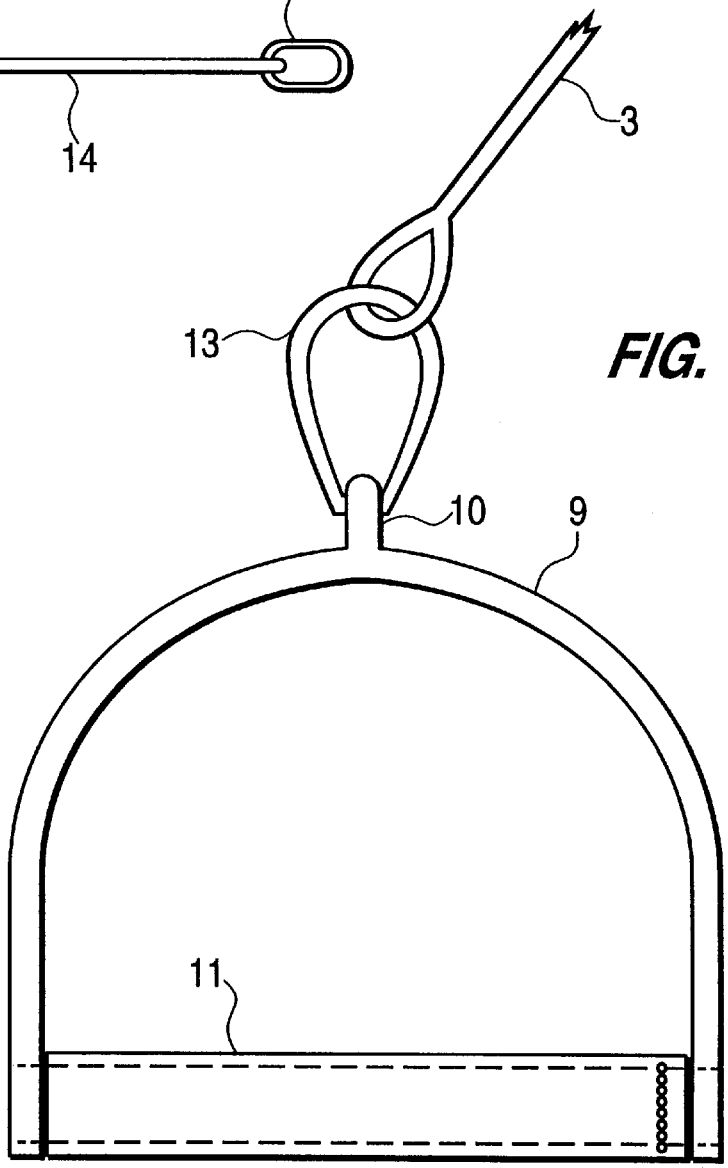
FIG. 3 is a top plan view of a hand grip member usable in an apparatus according to the present invention.

In FIGS. 3 and 4 an embodiment of the hand grip 6 is shown in greater detail. The hand grip 6 has the form of a yoke 9 with an attachment portion 10. A hand grip member 11, in the form of a tube, extends between the ends of the yoke 9 around which the hand grip member preferably is rotatable. The attachment portion 10 has a hole 12 for a span hook 13 in which the wire 3 may be attached by splicing the end of the wire 3 or in any other way.

Figure 6:
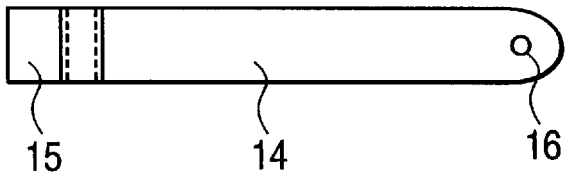
FIG. 6 is a front view of the attachment part of FIG. 5.
Figure 5:
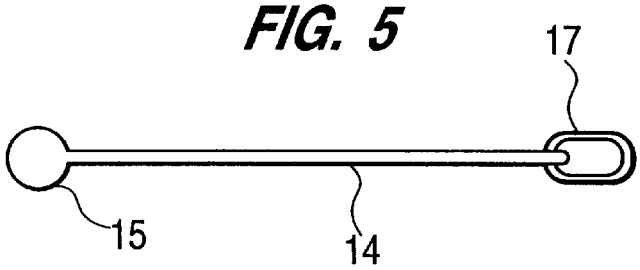
FIG. 5 is a view of an attachment part for an apparatus according to the present invention.

FIGS. 5 and 6 depict a strap 14, which at one end has a thickened portion 15 and at the opposite end has a hole 16 with a span hook 17. The strap 14 may substituted for the hook 5 as an attachment device on the wall surface 1 and may be applied at the upper edge of a door so as to be locked between the door and the door frame.

Figure 8:
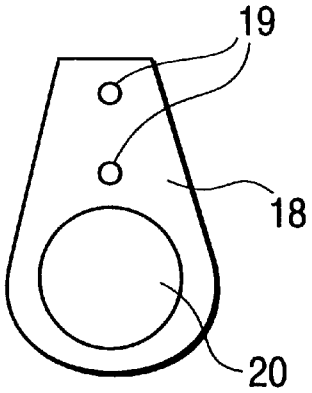
FIG. 8 is side view of a part of the hand grip of FIG. 7.
Figure 7:
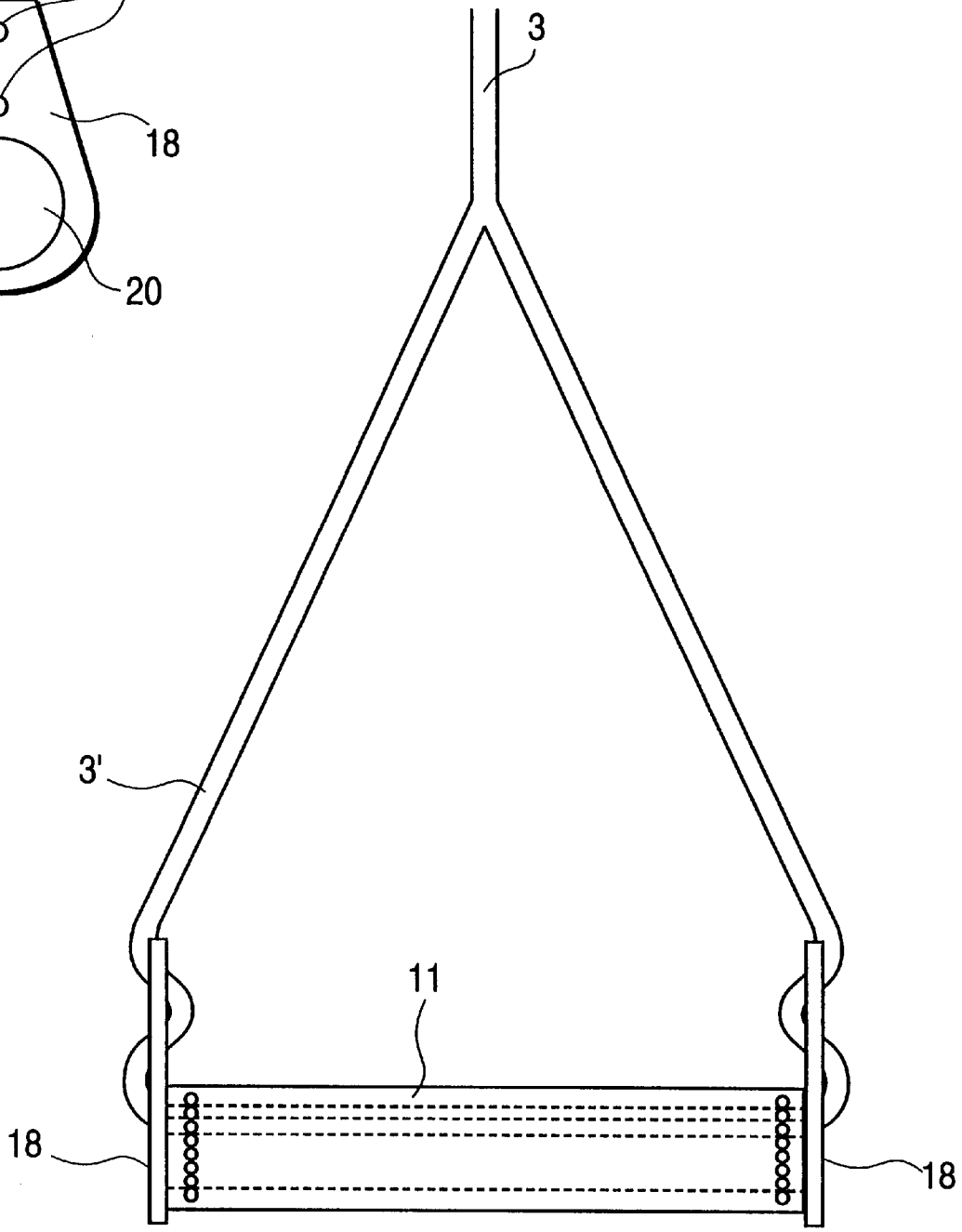
FIG. 7 is a top plan view of another hand grip usable in an apparatus according to the present invention.
Figure 12:
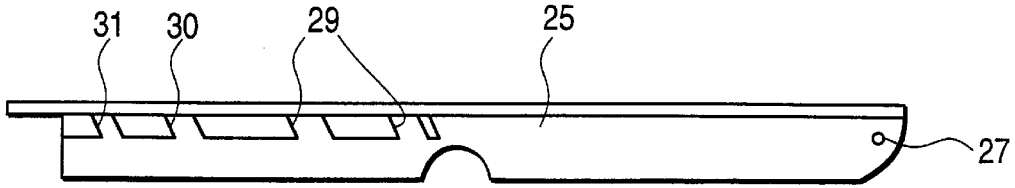
FIG. 12 is a side view of a top part of the foot support according to FIG. 10.
Figure 13:
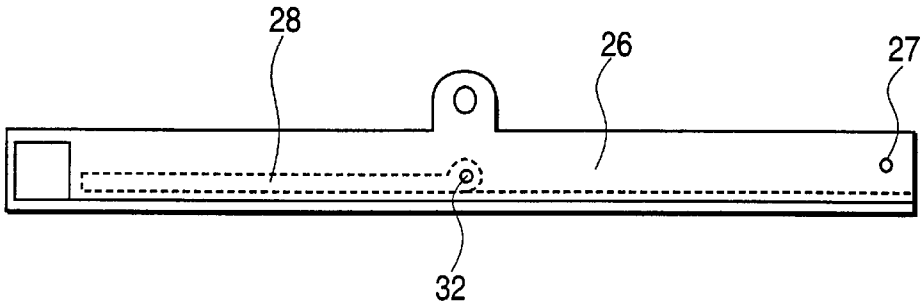
FIG. 13 is a side view of a bottom part of the foot support of FIG. 10.
Figure 16:
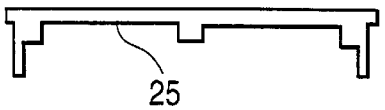
FIG. 16 is an end view of the top part shown in FIG. 12.
Figure 14:
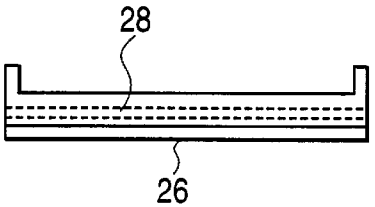
FIG. 14 is an end view of the bottom part shown in FIG. 13.
Figure 17:
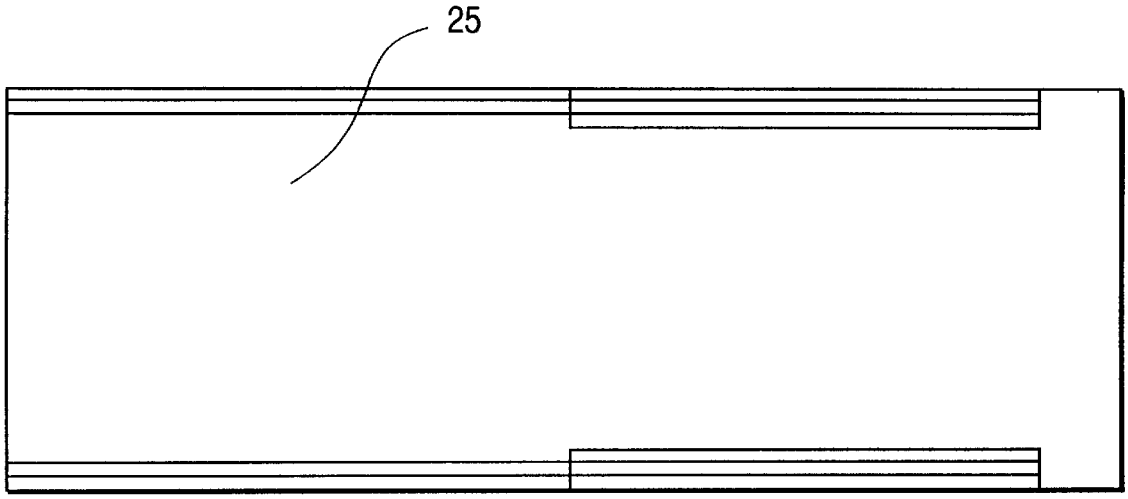
FIG. 17 is a bottom view of the top part shown in FIG. 12 and 16.
Figure 15:
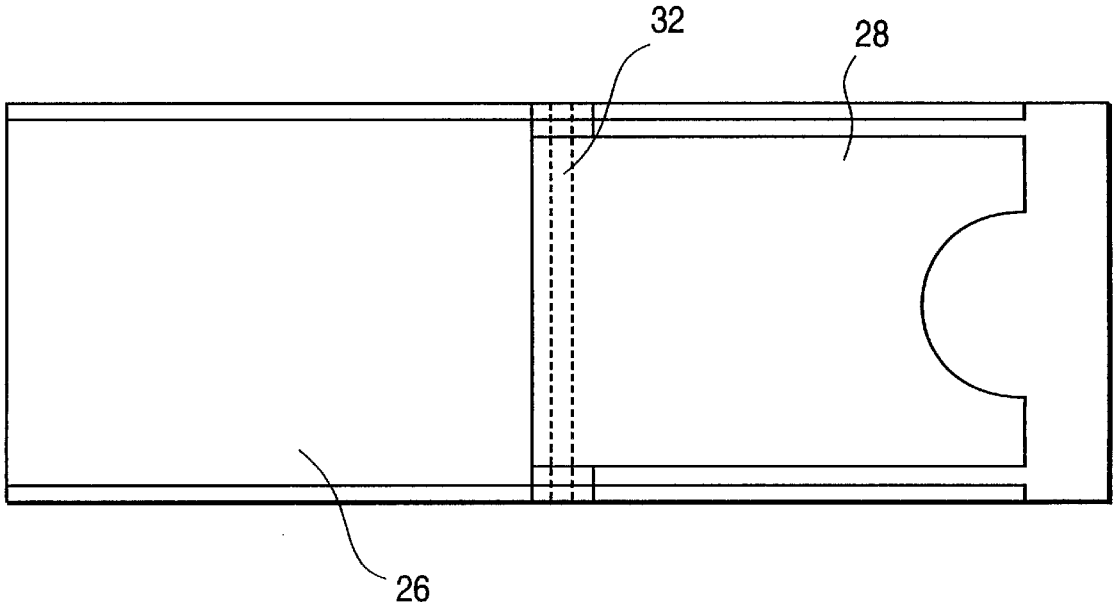
FIG. 15 is a bottom view of the bottom part shown in FIG. 13.

FIG. 7 depicts another embodiment of a hand grip in the form of a tube-formed hand grip member 11 arranged between two washers 18 of the type shown in FIG. 8. The washers 18 each have two holes 19 through which the wire 3 extends and thereafter through the tube formed hand grip member 11, as shown in FIG. 7. The washers 18 may have flanges extending into the hand grip member 11 for stabilization of the hand grip. The washers 18 have a further hole 20 for the wire 3. The big loop 3 in the wire 3 may be provided by splitting the end a distance on into the wire, which technique is well-known, or in any other way. The ends of the yoke 9 may be connected to each other via a bar or a tube and the hand grip member 11 may be rotatable on the bar or the tube with a bearing, e.g. balls, as is indicated in FIGS. 4 and 7. The washers 18 may be connected with each other and may carry the hand grip member 11 in a similar way.

FIG. 9 depicts a further embodiment of an attachment in the form of a strap 21, which may be arranged, for example, around a pillar or a bar or the like. The strap 21 has a number of holes 22 and a hole 23 at the end for a snap hook or the like. The holes 22 are arranged for cooperation with a known strap connector 24 with a catch pin at the end of the strap.

FIGS. 10–17 depict an arrangement of a foot support 7 for the apparatus according to the present invention. As shown, the foot support 7 may be raised and lowered and is maintained at a desired distance from the wall surface 1 with the aid of an arrangement of struts 8. Preferably, the arrangement of struts 8 is foldable in order to be easily transportable in a small piece of luggage. The foot support 7 comprises an upper plate 25, which is pivotable on a lower part 26 via a shaft 27, which is provided in the lower part 26. The lower part 26 has a foldable strut 28 which cooperates with the under side of the upper part 25 in a suitable recess 29, 30 or 31. The strut 28 may have the form of a plate, which is pivotable around a shaft 32, shown in FIGS. 13 and 15.

The different parts of the apparatus according to the present invention may be manufactured of plastic, sheet metal, wood, or the like, and the design of the same is not limited to the one as shown in the drawings but may be adjusted to different conditions. The parts according to the present invention may be carried in a simple bag, and besides the parts mentioned above may comprise an instruction book, instruction video, instruction tape, rubber bands or rubber loops, or the like, all of which parts together constitutes an extremely effective exercise gym. Within the scope of the present invention as defined in the enclosed claims are many different modifications.

I claim:

1. Apparatus for performing body exercises, comprising:

an elongated strap member having a first end, having a plurality of holes spaced longitudinally therealong, having a second end, and having a buckle connector connected to said second end and adapted to engage a first selected one of said holes to snugly connect said apparatus to a rigid support;

a wire adapted for detachable attachment to a second selected one of said plurality of holes to detachably connect said wire to the rigid support;

a hand grip member connected to said wire for permitting a person to grip said hand grip member, while said wire is connected by said strap to the rigid support; and a foot support adapted to be placed on a floor surface and including a support surface, a plurality of strut members adapted to be selectively positioned on the floor surface between said support surface and the rigid support to enable positioning of said support surface a selected distance from the rigid support, and adjustment means allowing said support surface to be fixedly disposed at a selected one of a plurality of angles with respect to the floor surface, to permit the person to stand on said support surface at a desired distance from the rigid support and grip said hand grip member at a desired angle with respect to the floor surface and to perform exercises.

2. Apparatus as claimed in claim 1, wherein said wire has a plurality of attachment members connected at spaced locations therealong, permitting said wire to be attached to a selected one of said plurality of holes.

3. Apparatus as claimed in claim 2 wherein said attachment members are loops formed in said wire.

4. Apparatus as claimed in claim 2 wherein said attachment members are spaced from said hand grip member.

5. Apparatus as claimed in claim 1, wherein said hand grip member comprises a yoke member having a yoke portion connected to said wire and a hand grip portion extending between ends of said yoke portion.

6. Apparatus as claimed in claim 4, wherein said hand grip portion comprises a tube rotatable connected to said ends of said yoke portion.

7. Apparatus as claimed in claim 6, wherein said wire includes an end loop on an end thereof, and said yoke portion has a snap hook part connecting said yoke member to said end loop.

8. Apparatus for performing body exercises comprising:

an attachment device adapted for detachable attachment to a rigid support;

a wire having a first end with an attachment member adapted for attachment to said attachment device, and having a second end;

at least one hand grip member connected to said wire second end to permit a person to grip said at least one hand grip member to perform exercises; and a foot support adapted to be placed on a floor surface, and having a support surface, a plurality of strut members adapted to be selectively positioned on the floor surface between said support surface and the rigid support to enable positioning of said support surface a selected distance from the rigid support, and adjustment means allowing said support surface to be fixedly disposed at a selected one of a plurality of angles with respect to the floor surface, to permit the person to stand on said support surface at a desired distance from the rigid support and grip said at least one hand grip member and at a desired angle with respect to the floor surface and to perform exercises.

9. Apparatus as claimed in claim 8, wherein said attachment device is an elongated strap member having a first end adapted to engage said attachment member to attach said wire to said strap member, and having a thickened second end adapted to be locked between a closed door and a door frame to permit the closed door and door frame to be utilized as the rigid support.

10. Apparatus as claimed in claim 8, wherein:

said attachment device comprises an elongated strap member having a first end; having a plurality of holes spaced longitudinally therealong, having a second end, and having a buckle connector connected to said second end and adapted to engage a first selected one of the holes to permit said strap member to be snugly attached to a pillar or bar;

said attachment member is adapted to engage a second selected one of the holes to permit the pillar or bar to be utilized as the rigid support.

11. Apparatus as claimed in claim 8, wherein said at least one hand grip member comprises a yoke-shaped hand grip member, including a yoke portion connected to said wire second end and having a pair of distal ends, and including a tube-shaped hand grip portion rotatably attached to said pair of distal ends.

12. Apparatus permitting a person to perform body exercises, said apparatus comprising:

an elongated strap member having a first end, having a plurality of holes spaced longitudinally there along, having a second end, and having a buckle connector connected to said second end and adapted to engage a first selected one of said holes to temporarily snugly and releasably connect said apparatus to a rigid support at a position above the head of the person;

a wire adapted for detachable attachment to a second selected one of said plurality of holes to detachably connect said wire to the rigid support;

a hand grip member connected to said wire for permitting the person to grip said hand grip member, while said wire is connected by said strap to the rigid support; and a foot support adapted to be placed on a floor surface and including a support surface, a plurality of strut members adapted to be selectively positioned on the floor surface between said support surface and the rigid support to enable positioning of said support surface a selected distance from the rigid support, and adjustment means allowing said support surface to be fixedly disposed at a selected one of a plurality of angles with respect to the floor surface, to permit the person to stand on said support surface at a desired distance from the rigid support, reach up at a desired angle with respect to the floor surface, and grip said hand grip member and to perform exercises.

13. Apparatus permitting a person to perform body exercises, said apparatus comprising:

an attachment device adapted for temporary releasable attachment to a rigid support at a position above the head of the person;

a wire having a first end with an attachment member adapted for attachment to said attachment device, and having a second end;

at least one hand grip member connected to said wire second end to permit the person to grip said at least one hand grip member to perform exercises; and a foot support adapted to be placed on a floor surface and including a support surface, a plurality of strut members adapted to be selectively positioned on the floor surface between said support surface and the rigid support to enable positioning of said support surface a selected distance from the rigid support, and adjustment means allowing said support surface to be fixedly disposed at a selected one of a plurality of angles with respect to the floor surface, to permit the person to stand on said support surface at a desired distance from the rigid support, reach up at a desired angle with respect to the floor surface, and grip said hand grip member and to perform exercises.

14. Apparatus for performing body exercises, comprising:

a wire;

an attachment member connected on said wire and adapted for detachable attachment to a rigid support;

at least one hand grip member connected to said wire for permitting a person to grip said at least one hand grip member, while said attachment member is connected to the rigid support;

a foot support adapted to be placed on a floor surface and including a support surface, a plurality of strut members adapted to be selectively positioned on the floor surface between said support surface and the rigid support to enable positioning of said support surface a selected distance from the rigid support, and adjustment means allowing said support surface to be fixedly disposed at a selected one of a plurality of angles with respect to the floor surface, to permit the person to stand on said support surface at a desired distance from the rigid support and grip said at least one hand grip member at a desired angle with respect to the floor surface and to perform exercises.

* * * * *